US007293311B2

(12) United States Patent
Baker

(10) Patent No.: US 7,293,311 B2
(45) Date of Patent: Nov. 13, 2007

(54) METHOD OF MAKING A MULTILAYERED MATTRESS COMPONENT

(75) Inventor: Daniel J. Baker, North Salt Lake City, UT (US)

(73) Assignee: Spring Air West, L.L.C., Salt Lake City, UT (US)

( * ) Notice: Subject to any disclaimer, the term of this patent is extended or adjusted under 35 U.S.C. 154(b) by 0 days.

(21) Appl. No.: 10/793,565

(22) Filed: Mar. 4, 2004

(65) Prior Publication Data

US 2005/0193497 A1 Sep. 8, 2005

(51) Int. Cl.
*A47C 17/00* (2006.01)

(52) U.S. Cl. ..... 5/721; 5/730

(58) Field of Classification Search ..... 5/721, 5/727, 722, 730, 740, 901
See application file for complete search history.

(56) References Cited

U.S. PATENT DOCUMENTS 3,026,544 A * 3/1962 Persicke et al. ..... 428/101
3,083,380 A * 4/1963 Adler ..... 5/727
3,152,343 A * 10/1964 Brown ..... 441/118
3,222,697 A * 12/1965 Scheermesser ..... 428/160
3,319,274 A * 5/1967 Upton ..... 5/701
3,940,811 A * 3/1976 Tomikawa et al. ..... 5/740
4,053,957 A * 10/1977 Regan ..... 5/727
4,137,585 A * 2/1979 Wright, III ..... 405/193
4,623,316 A * 11/1986 Ratliff ..... 441/106
4,752,263 A * 6/1988 Pritchard et al. ..... 114/88
5,077,849 A * 1/1992 Farley ..... 5/730
5,136,740 A * 8/1992 Kraft ..... 5/730
5,199,820 A * 4/1993 Nicklo ..... 405/186
5,243,722 A * 9/1993 Gusakov ..... 5/655.3
5,255,404 A * 10/1993 Dinsmoor et al. ..... 5/677
5,295,765 A * 3/1994 Choi ..... 405/186
5,304,271 A * 4/1994 Gusakov ..... 156/145
5,353,455 A * 10/1994 Loving et al. ..... 5/730
5,367,727 A * 11/1994 Dyer, Jr. ..... 5/678
5,466,179 A * 11/1995 Jeffrey, Sr. ..... 441/108
5,523,144 A * 6/1996 Dyer, Jr. ..... 428/158
5,551,353 A * 9/1996 Fiedler ..... 108/51.3
5,800,228 A * 9/1998 Hernandez ..... 441/94
5,800,905 A * 9/1998 Sheridan et al. ..... 428/157
5,802,646 A 9/1998 Stolpmann et al. ..... 5/740
5,815,865 A * 10/1998 Washburn et al. ..... 5/713
5,836,027 A * 11/1998 Leventhal et al. ..... 5/706
5,940,913 A * 8/1999 Horowitz ..... 5/640
5,974,609 A * 11/1999 Nunez et al. ..... 5/717
6,115,861 A 9/2000 Reeder et al. ..... 5/727

(Continued)

*Primary Examiner*—Tara L. Mayo
(74) *Attorney, Agent, or Firm*—Holme Roberts & Owen LLP

(57) ABSTRACT

A method of making a mattress component includes providing a first layer of a first material. Mating patterns are shaped in a surface of the first layer in areas corresponding to a position where hips and shoulders of the user will rest on a mattress. The mating patterns in the surface of the first layer result in a greater effective thickness of the first layer in areas corresponding to the position where the hips and the shoulders will rest, and a lesser effective thickness of the first layer in other areas. A second layer has a second material with different properties than the first material. Mating patterns are shaped in a surface of the second layer in areas corresponding to the mating patterns of the first layer and shaped to substantially match with the mating patterns of the first layer.

21 Claims, 8 Drawing Sheets

U.S. PATENT DOCUMENTS

| | | | | |
|---|---|---|---|---|
| 6,223,371 | B1 * | 5/2001 | Antinori et al. | 5/727 |
| 6,269,504 | B1 * | 8/2001 | Romano et al. | 5/690 |
| 6,345,401 | B1 * | 2/2002 | Frydman | 5/636 |
| 6,378,152 | B1 | 4/2002 | Washburn et al. | 5/713 |
| 6,447,874 | B2 * | 9/2002 | Antinori et al. | 428/102 |
| 6,460,209 | B1 * | 10/2002 | Reeder et al. | 5/690 |
| D479,082 | S * | 9/2003 | Daughtery et al. | D6/596 |
| 6,807,698 | B2 * | 10/2004 | Torbet et al. | 5/727 |
| 7,058,999 | B2 * | 6/2006 | Horitani et al. | 5/618 |
| 7,090,911 | B2 * | 8/2006 | Lascelles | 428/163 |
| 2005/0066446 | A1 * | 3/2005 | Gladney | 5/690 |

* cited by examiner

METHOD OF MAKING A MULTILAYERED MATTRESS COMPONENT

BACKGROUND OF THE INVENTION

1. The Field of the Invention

The present invention generally relates to a mattress, more specifically the invention relates to mattress components having a multiple layers.

2. The Relevant Technology

Mattress products generally include a cushion made from foam, cotton or other soft material batting. Recent developments in mattress products have modified mattress layers to gain additional comfort. Some designs include a mattress layer that has a surface defined by peaks and valleys or other layer combinations that form voids between the mattress layers. Although mattress layers with peaks and valleys generally reduce pressure points, the shape of the layer can adversely affect the uniformity of a mating fiber layer, and/or be felt by a user through the fiber layer and a mattress outer fabric layer, giving the mattress a bumpy feel. In addition, the characteristics of the layer material cannot be controlled in an area where there are voids. Voids introduce an additional unknown characteristic. Furthermore, voids can create a weak spot in the mattress material, which can reduce, over time, the comfort of the mattress pad.

In U.S. Pat. No. 5,974,609 to Nunez et al., a quilt top mattress is disclosed including a spring unit and a cover fabric layer surrounding the spring unit. A quilt top layer overlies the cover fabric layer. The quilt top layer includes an outer fabric layer, a fiber batt layer, a convoluted foam cushion and an inner fabric layer. All the components in the quilt top layer are secured together by stitching to define a select quilt pattern. The convoluted foam cushion is reversed from that of other mattresses so that a planar outer surface is in contact with the fiber batt layer, and a convoluted inner surface defined by alternating peaks and valleys faces the spring unit.

As a result, the arrangement of the peaks prevents the peaks from pushing through the fiber layer, which would cause the fibers to separate and the valleys to rest between the peaks. In this related reference, however, the mattress component layers use peaks and valleys that create voids between the layers of the mattress material. The voids, as discussed above introduce an additional uncontrolled characteristic and can create a weakness in the mattress material, which in turn can reduce the comfort and durability of the mattress pad.

In view of the above and other related drawbacks and limitations identified in the relevant mattress products, there is a need for a mattress component that allows variation in the layer properties of the multiple layers.

BRIEF SUMMARY OF THE INVENTION

In various exemplary embodiments of the present invention, a mattress component is provided. The mattress component includes first and second layers to be assembled in a mattress over which a user will lie. The first layer is of a first material having different properties than the second material. The second layer has a surface underlying a surface of the first layer.

Mating patterns are formed in the surface of the first layer and the surface of the second layer. The mating patterns in the surfaces of the first and second layers are designed to substantially match the surface of the first layer with the surface of the second layer. The mating patterns in the surfaces of the first and second layers result in a greater effective thickness of either the first layer or the second layer in areas corresponding to a position where hips and shoulders of the user will rest on the mattress, and a lesser effective thickness of the same the first or second layer in other areas.

In another embodiment of the invention, a method of making a mattress component is provided. The method includes the step of providing a first layer of a first material to be assembled in a mattress over which a user will lie. Then, the method includes the step of shaping mating patterns in a surface of the first layer in areas corresponding to a position where hips and shoulders of the user will rest on the mattress. The mating patterns in the surface of the first layer result in a greater effective thickness of the first layer in areas corresponding to the position where the hips and the shoulders of the user will rest, and a lesser effective thickness of the first layer in other areas.

The method also includes the step of providing a second layer of a second material having different properties than the first material. Next, the method includes the step of shaping mating patterns in a surface of the second layer in areas corresponding to the mating patterns in the surface of the first layer when the first and second layers are aligned. The mating patterns of the second layer are shaped to substantially match the mating patterns of the first layer.

These and other features of the present invention will become more fully apparent from the following description and appended claims, or may be learned by the practice of the invention as set forth hereinafter.

BRIEF DESCRIPTION OF THE DRAWING

To further clarify the above and other advantages and features of the present invention, a more particular description of the invention will be rendered by reference to specific embodiments thereof which are illustrated in the appended drawings. It is appreciated that the drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made in detail to the preferred embodiments of the present invention, examples of which are illustrated in the accompanying drawings. The various exemplary embodiments provide examples of mattress component layers including variation zones. The variation zones change the characteristics of the mattress by varying the thickness of a given layer.

By varying the firmness of the different layers, the variation zones provide additional comfort to particular areas. For example, the variation zones can accommodate different anatomical portions of a user, such as the head, neck and shoulder area, the lumbar area, and the hip area. In the variation zones, mating patterns are formed to substantially eliminate voids or air gaps, yet provide variation in the layer properties, such as firmness. The quantity and location of each of the variation zones may be suitably selected to provide any desired pattern of support.

Figure 1:
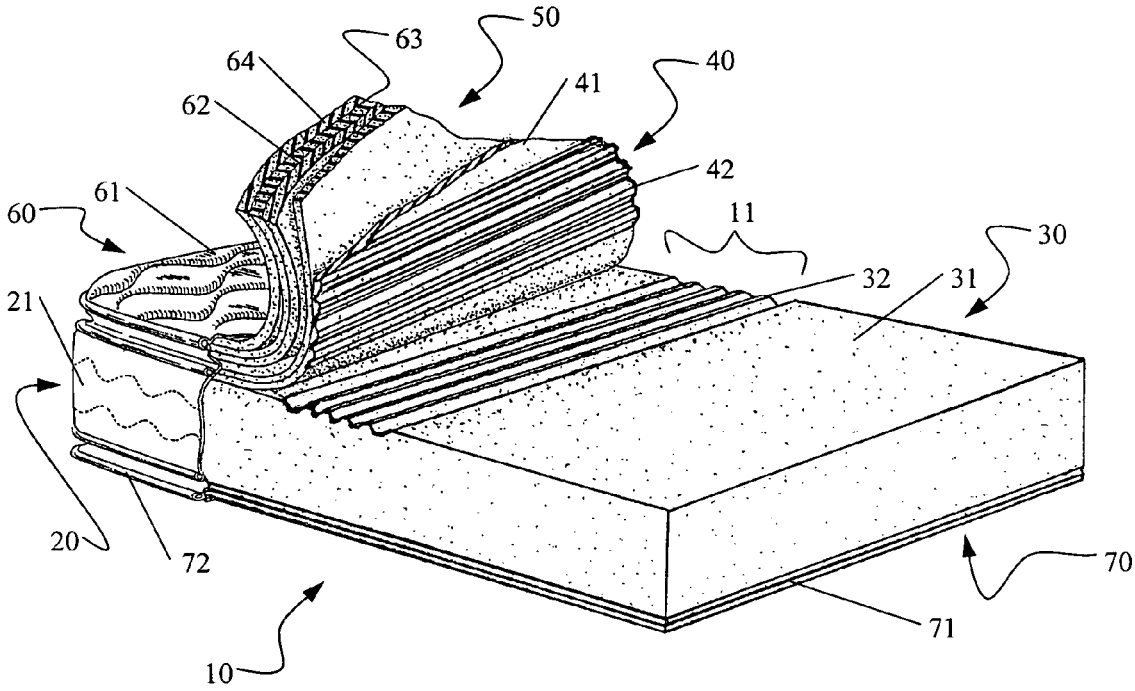
FIG. 1 is a perspective view of an embodiment of interior portions of a mattress including multiple layers in accordance with the present invention.

One embodiment of a mattress 10 is illustrated in FIG. 1 in accordance with the present invention. FIG. 1 illustrates the mattress 10 including a mattress cover 20, a mattress layer 30, a mating layer 40, an upper layer 50, a quilt top 60 and a base layer 70. It should be appreciated that the structure of the mattress of FIG. 1 corresponds to a "deluxe" or "quilt top" mattress. A less expensive mattress may be provided by omitting one or more of the layers, or the quilt top altogether. The present invention may reduce the layers down to two layers, such as the mating layer 40 and the mattress layer 30.

In this embodiment, the mattress 10 is a foam mattress pad structure including variation zones 11, which does not require a spring unit. The variation zones 11 are zones that provide a variation in the properties of the materials by making the effective thickness of the material thicker or thinner. When the material is thicker, the characteristics of the thicker area enhances the material properties. When the material is thinner, however, the characteristics of the thinner area diminishes the material properties, yet enhances the properties of the mating layer. The properties of the materials to be enhanced or diminished can include, for example, density, compression, sag factor, hysteresis, fatigue loss, tensile strength, elongation and tear. By changing the characteristics of the layers, the mattress 10 may be modified to change portions of the mattress 10 to range between soft, medium, firm and extra firm. Hence, the variation zones 11 can provide extra support or comfort where desired.

The mattress cover 20 includes a material 21 that completely surrounds the inner components of the mattress 10. The material 21 of the mattress cover 20 is preferably made from a woven fabric, but may also include materials such as cotton and wool fibers, terry cloth fabric, synthetic fibers, vinyl, antibacterial fabric and other known materials. The mattress cover 20 may be quilted or patterned to provide additional softness and aesthetic appeal.

The mattress layer 30 includes an upper surface 31 and mating patterns 32. The mating patterns 32 are provided in the variation zones 11. The mattress layer 30 can be made, for example, of a high resilient foam, a high density foam, a latex foam or similar supportive material. Mating patterns 32 are cut or formed into the upper surface 31 of the mattress layer 30. The mating patterns 32 are cut or formed, for example, by a reciprocating saw, a laser, a shear, a die-cut punch, molding or other known methods. The terms cut and formed are meant to be construed disjunctively so as to mean shaped by either cutting or forming within meaning of the specification and claims.

The mating layer 40 includes a lower surface 41 and mating patterns 42. The mating patterns 42 are provided in the variation zones 11 to mate, match or fit with the mating patterns 32 of the mattress layer 30. The mating patterns 42 are formed in the lower surface 41 with a complementary patterns so that the mating patterns 42 substantially fit into the mating patterns 32 of the mattress layer 30. The mating layer 40 can be made, for example, of a visco-elastic foam known as memory foam, a polyurethane foam, high resilient foam, high density foam, latex foam or similar material.

The upper layer 50 can be provided above the mating layer 40 to enhance the comfort or add other qualities to the mattress 10. The upper layer 50, like all the other layers in the mattress, can be made, for example, of a visco-elastic foam, a polyurethane foam, high resilient foam, high density foam, gel, latex foam or similar material depending on the characteristics desired. In addition, the upper layer 50, as well as the other materials, can be made of a hypo-allergenic material, heat resistant or retaining material or any other material, which adds other known qualities to the mattress 10.

The quilt top 60 includes a cover 61 and foam layers 62 through 64 to provide additional comfort and/or support. The foam layers 62 through 64 are contained in the quilt top 60 using the cover 61. The cover 61 of the quilt top 60 is secured to the mattress cover 20 by a connector such as a fabric flange or threading. Instead of using a quilt top 60, the foam layers 62 through 64 may directly overlie the upper layer 50 and contained within the mattress cover 20.

The base 70 includes a support layer 71 and a support cover 72. The support layer 71 can be made from a rigid material such as high density foam, plastic, wood, metal or other known material. The support cover 72 encloses the support layer 71 and attaches to the mattress cover 20 by a connector such as a fabric flange or threading.

Figure 2:
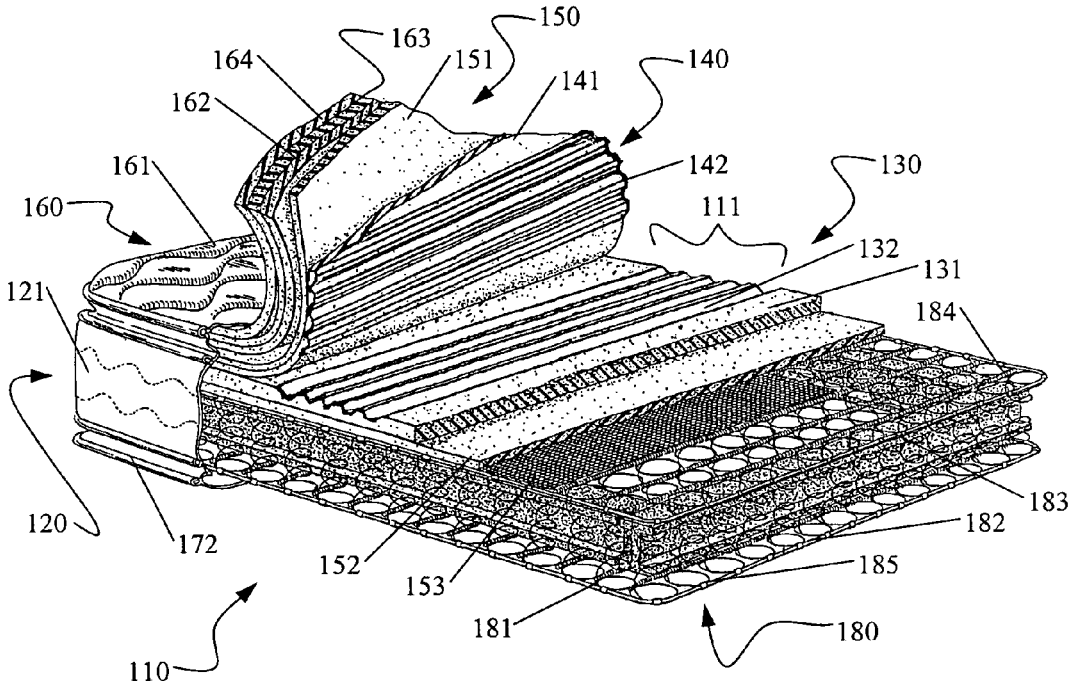
FIG. 2 is a perspective view of another embodiment of interior portions of a mattress including multiple layers in accordance with the present invention.

Another embodiment of a mattress 110 is illustrated in FIG. 2 in accordance with the present invention. In FIG. 2, the mattress 110 is illustrated including a mattress cover 120, a mattress layer 130, a mating layer 140, a padding array 150, a quilt top 160, a base layer 170 and a spring unit 180.

The structure of the mattress of FIG. 2 also corresponds to a "deluxe" or "quilt top" mattress, in which layers may be reduced or omitted to provide a less expensive mattress.

In this embodiment, the mattress 110 combines the spring unit 180 with a padding array 150. The mattress 110 includes variation zones 111, which provide variations in the properties of the materials by making the effective thickness of the material thicker or thinner, similar to the variation zone 11 discussed above.

The mattress cover 120 includes a material 121 that completely surrounds the inner components of the mattress 110. The material 121 of the mattress cover 120 is similar to that of the material 21 discussed above.

The mattress layer 130 includes an upper surface 131 and mating patterns 132. The mating patterns 132 are provided in the variation zones 111. The mattress layer 130 can be made, for example, of a high resilient foam, a high density foam, a latex foam or similar supportive material. Mating patterns 132 are cut or formed into the upper surface 131 of the mattress layer 130. The mating patterns 132 are cut or formed as discussed above with respect to mating patterns 32.

The mating layer 140 includes a lower surface 141 and mating patterns 142. The mating patterns 142 are provided in the variation zones 111 to mate, match or fit with the mating patterns 132 of the mattress layer 130. The mating patterns 142 are formed in the lower surface 141 with a complementary patterns so that the mating patterns 142 substantially fit into the mating patterns 132 of the mattress layer 130. The mating layer 140 can be made, for example, of a visco-elastic foam known as memory foam, a polyurethane foam, high resilient foam, high density foam, latex foam or similar material.

The padding array 150 can be provided above the mating layer 140 and below the mattress layer 130 to enhance the comfort or add other qualities to the mattress 110. The padding array 150 includes an upper layer 151, a lower layer 152 and a mesh layer 153. The upper and lower layers 151, 152, like all the other layers in the mattress, can be made, for example, of a visco-elastic foam, a polyurethane foam, high resilient foam, high density foam, latex foam or similar material depending on the characteristics desired. Additionally, the upper and lower layers 151, 152, as well as the other materials, can be made of a hypo-allergenic material, heat resistant or retaining material or any other material, which adds other known qualities to the mattress 110. the mesh layer 153 provides a barrier between the spring unit 180 and the overlaying layers.

The quilt top 160 including a cover 161 and foam layers 162 through 164 is provided to enhance comfort and/or support. The foam layers 162 through 164 are contained in the quilt top 160 using the cover 161 and are of a similar material as foam layers 62 through 64 discussed above. The cover 161 of the quilt top 160 is secured to the mattress cover 120 by a connector such as a fabric flange or threading.

The base 170 includes a support layer 171 and a support cover 172. The support layer 171 can be made from a rigid material such as high density foam, plastic, wood, metal or other known material. The support cover 172 encloses the support layer 171 and attaches to the mattress cover 120 by a connector such as a fabric flange or threading.

The spring unit 180 includes coil springs 181, upper border wire 182, lower border wire 183, connecting rods 184 and connectors 185. The overall shape of the spring unit 180 is defined by a pair of conventional, spaced-apart, generally rectangular border wires 182, 183. Multiple arrays of spring coils 181 are provided between the upper and lower border wires, which define two planes. The coil springs 181 are secured to the border wires 182, 183 in a conventional manner by a number of connecting rods 184, which run across the width of the spring unit 180. The connecting rods may be made of a material, such as, a metallic or plastic rod or wire.

Each of the connecting rods 184 is connected to the coil springs using an attachment device, such as a wire spirally wound around the connecting rod 184 and the uppermost (or lowermost) convolution of each of the coil springs 181. The wire can be wound around two adjacent rows of the coil springs 181 associated with each connecting rod 184 to hold the coil springs 181 in place. The connectors 185 are used to attach peripheral rows of the coil springs 181 of the spring unit 180 to the upper and lower border wires 182, 183. The connectors 185 are made, for example, of a metallic or plastic ring-like device or wire that can wrap around the coil springs 181 and the border wires 182, 183.

Figure 3:
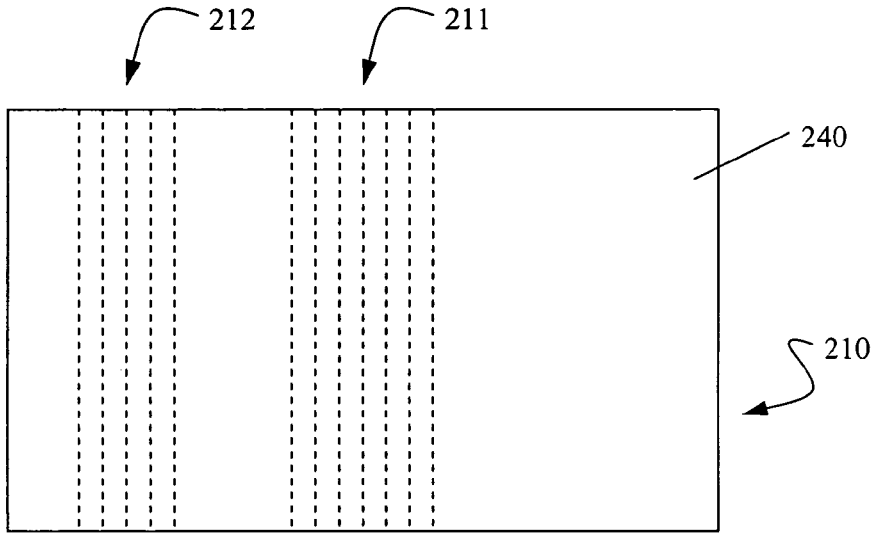
FIG. 3 is a schematic top view of an embodiment of mattress component layers including variation zones in accordance with the present invention.
Figure 4:
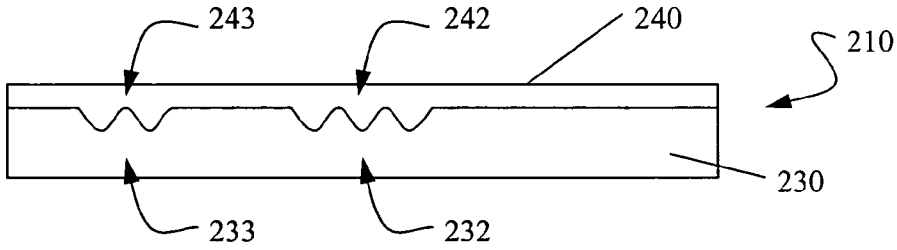
FIG. 4 is a side view of the mattress component layers of FIG. 3.
Figure 5:
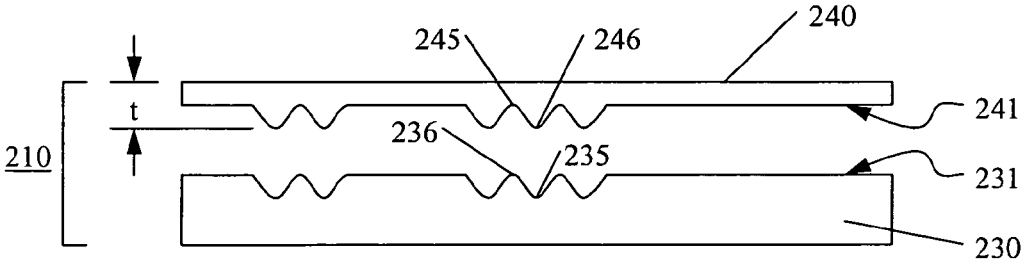
FIG. 5 is an assembly view of the mattress component layers of FIG. 4.

FIGS. 3-5 illustrate a schematic view of a mattress component 210 in accordance with the present invention. In FIG. 3, the mattress component 210 is illustrated including a first variation zone 211 and a second variation zone 212. The first and second variation zones 211, 212 are similar to the variation zone 11 of FIG. 1. In this embodiment, the first variation zone 211 is positioned where hips of a user will rest on the mattress component 210. The second variation zone 212 is positioned where shoulders of a user will rest on the mattress component 210. The first and second variation zones 211, 212 may be shaped having different zone widths and depths. For example, the first variation zone 211 can be wider than the second variation zone 212, as shown in FIGS. 3-5. The mattress component 210, as applied to the various embodiments of the present invention, may be inserted into any partial or complete layer of a mattress. For example, when edge supports are used, the mattress component 210 would be inserted into a center section of the mattress.

The mattress component 210 includes a first layer 240 and a second layer 230. The first and second layers 240, 230 can be made of different materials. For example, the first and second layers 240, 230 can be made of a visco-elastic foam known as memory foam, a polyurethane foam, high resilient foam, high density foam, latex foam or similar material.

The first layer 240 includes mating patterns 242, 243. The second layer 230 includes mating patterns 232, 233. The mating patterns 232 are provided in the variation zone 211 to substantially match the mating patterns 242 of the mattress component 210 in the hip area. In addition, the mating patterns 233 are provided in the variation zone 212 to substantially match the mating patterns 243 of the mattress component 210 in the shoulder area.

For example, the first layer 240 has a surface 241 formed with mating patterns 242 including peaks 246 and valleys 245. The second layer 230 has a surface 231 formed with mating patterns 232 including peaks 236 and valleys 235. The peaks 246 are formed in the surface 241 to match the valleys 235 formed in the surface 231. Likewise, the peaks 236 are formed in the surface 231 to match the valleys 245 formed in the surface 241.

The peaks 246 in the surface 241 of the first layer 240 provide an effective thickness t, which is greater than the remaining thickness of the first layer 240. For example, the remaining thickness may be between about 0.5 to 2 inches and the effective thickness may be between about 1 to 4 inches. The variation zones 211, 212 provide a variation in the properties of the materials by making the effective thickness t of the first layer 240 thicker, while the remainder of the mattress component 210 retains the remaining layer thickness. In the present embodiment, the material in the first layer is thicker in the variation zones 211, 212, which enhances the material properties of the first layer 240. In the other areas the material in the first layer 240 is thinner, which diminishes the material properties of the first layer 240, yet enhances the material properties of the second layer 230. Thus, the variation zones 211, 212 can provide extra comfort where desired, while retaining the extra support in the other areas.

Figure 6:
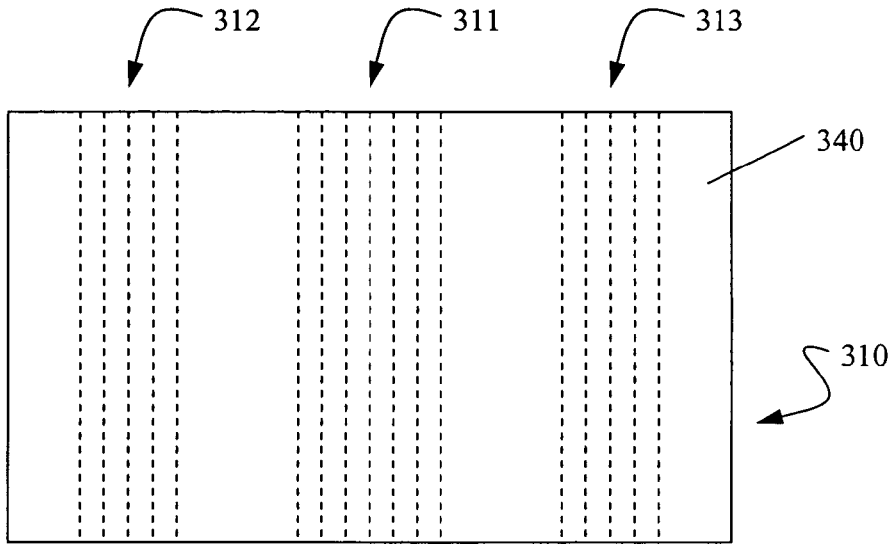
FIG. 6 is a schematic top view of another embodiment of mattress component layers including variation zones in accordance with the present invention.
Figure 7:
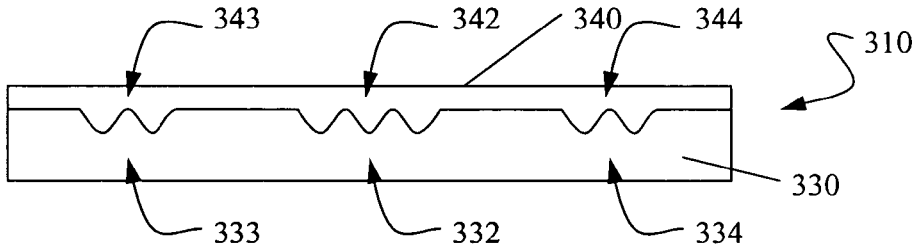
FIG. 7 is a schematic side view of the mattress component layers of FIG. 6.
Figure 8:
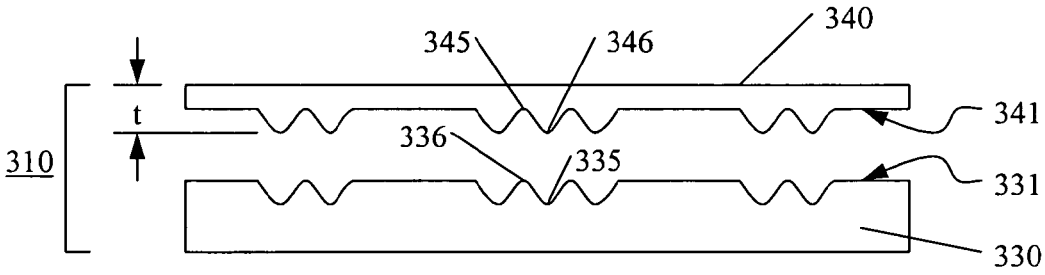
FIG. 8 is an assembly view of the mattress component layers of FIG. 7.

FIGS. 6-8 illustrate a schematic view of another embodiment of a mattress component 310 in accordance with the present invention. In FIG. 6, the mattress component 310 is illustrated including a first variation zone 311, a second variation zone 312 and a third variation zone 313. The first, second and third variation zones 311, 312, 313 are similar to the variation zone 11 of FIG. 1. In this embodiment, the first variation zone 311 is positioned where hips of a user will rest on the mattress component 310. The second variation zone 312 is positioned where shoulders of a user will rest on the mattress component 310. The third variation zone 313 is positioned where shoulders of a user will rest on the mattress component 310 when the mattress component 310 is rotated about 180 degrees with respect to the user. The first, second and third variation zones 311, 312, 313 may be shaped having different zone widths. For example, the first variation zone 311 can be wider than the second and third variation zones 312, 313 as shown in FIGS. 6-8.

The mattress component 310 includes a first layer 340 and a second layer 330. The first and second layers 340, 330 can be made of different materials as discussed above. The first layer 340 includes mating patterns 342, 343, 344. The second layer 330 includes mating patterns 332, 333, 334. The mating patterns 332 are provided in the variation zone 311 to substantially match the mating patterns 342 of the mattress component 310 in the hip area. In addition, the mating patterns 333 are provided in the variation zone 312 to substantially match the mating patterns 343 of the mattress component 310 in the shoulder area. Further, the mating patterns 334 are provided in the variation zone 313 to substantially match the mating patterns 344 of the mattress component 310 in the shoulder area when the mattress component 310 is rotated about 180 degrees with respect to the user.

For example, the first layer 340 has a surface 341 formed with mating patterns 342 including peaks 346 and valleys 345. The second layer 330 has a surface 331 formed with mating patterns 332 including peaks 336 and valleys 335. The peaks 346 are formed in the surface 341 to match the valleys 335 formed in the surface 331. Likewise, the peaks 336 are formed in the surface 331 to match the valleys 345 formed in the surface 341.

The peaks 346 in the surface 341 of the first layer 340 provide an effective thickness t, which is greater than the remaining thickness of the first layer 340. The variation zones 311, 312, 313 provide a variation in the properties of the materials by making the effective thickness t of the first layer 340 thicker, while the remainder of the mattress component 310 retains the remaining layer thickness. The material in the first layer 340 is varied to provide additional comfort or support as discussed above.

Figure 9:
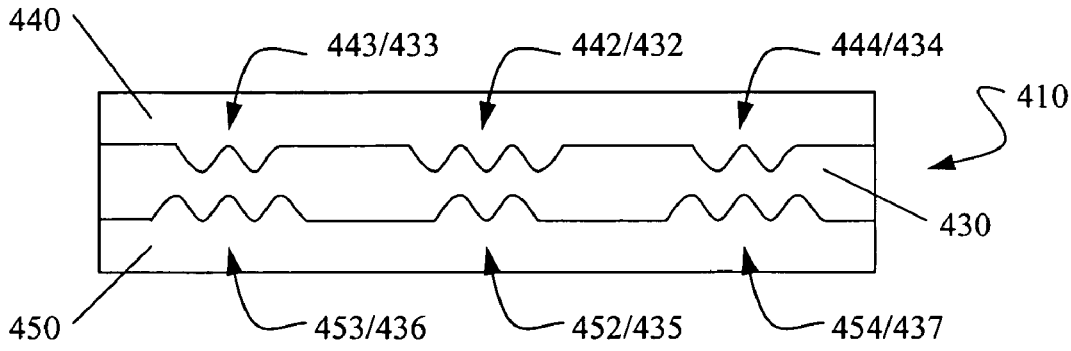
FIG. 9 is a schematic side view of a further embodiment of mattress component layers including differing variation zones on opposing mattress component layers in accordance with the present invention.

In FIG. 9, a schematic side view of another embodiment of a mattress component 410 is illustrated in accordance with the present invention. FIG. 9 shows the mattress component 410 including a second layer 430 sandwiched between a first layer 440 and a third layer 450, each layer having three variation zones. The first layer 440 includes first through third mating patterns 442, 443, 444. The second layer 430, since it is matching the third layer 450, includes first through sixth mating patterns 432-437. The third layer includes mating patterns 452, 453, 454.

In the present embodiment, the mating patterns 442, 443, 444 in the first layer 440 are provided to substantially match the mating patterns 432, 433, 434, respectively, in a first surface of the second layer 430. In addition, the mating patterns 452, 453, 454 in the third layer 450 are provided to substantially match the mating patterns 435, 436, 437, respectively, in a second surface of the second layer 430. The mating patterns 442, 443, 444 in the first layer 440 are optionally different widths than the mating patterns 452, 453, 454 in the third layer 450. For example, the mating patterns 442 have three rows of peaks and the mating patterns 452 have two rows of peaks. The different widths can provide additional variation in the material properties of the layers.

Figure 10:
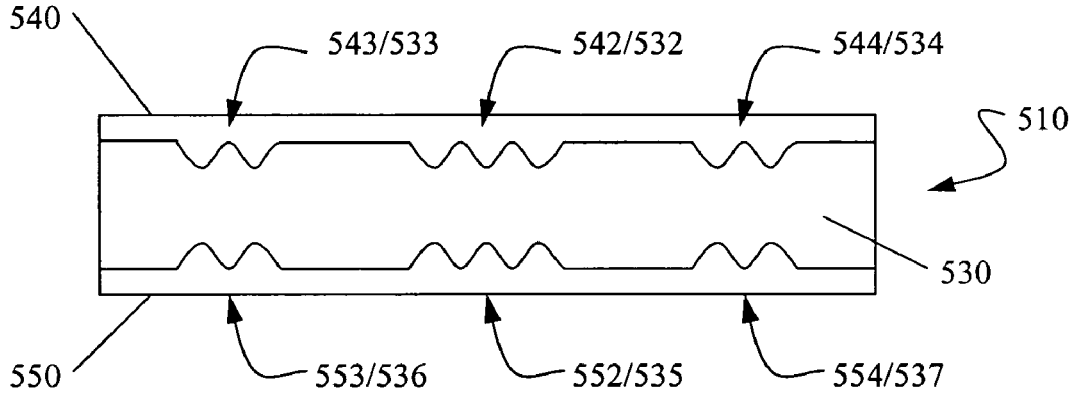
FIG. 10 is a schematic side view of a further embodiment of mattress component layers including similar variation zones on opposing mattress component layers in accordance with the present invention.

FIG. 10 illustrates a schematic side view of a further embodiment of a mattress component 510 in accordance with the present invention. The mattress component 510 includes a second layer 530 sandwiched between a first layer 540 and a third layer 550 each layer having three variation zones. The first layer 540 includes first through third mating patterns 542, 543, 544. The second layer 530, matching the first and third layers 530, 550, includes first through sixth mating patterns 532-537. The third layer includes mating patterns 552, 553, 554.

The mating patterns 542, 543, 544 in the first layer 540 are provided to substantially match the mating patterns 532, 533, 534, respectively, in a first surface of the second layer 530. In addition, the mating patterns 552, 553, 554 in the third layer 550 are provided to substantially match the mating patterns 535, 536, 537, respectively, in a second surface of the second layer 530. In the present embodiment, the mating patterns 542, 543, 544 in the first layer 540 have the same widths as the mating patterns 552, 553, 554 in the third layer 550. For example, the mating patterns 542, 552 have the same three rows of peaks. Also, the mating pattern widths may vary depending on a particular variation zone. For example, the mating patterns 543, 553 have the same rows of peaks that varies from that of mating patterns 542, 552. Mating patterns with the same widths can allow the mattress component to be flipped over from top to bottom and still maintain the same variation in the material properties of the layers.

Figure 11:
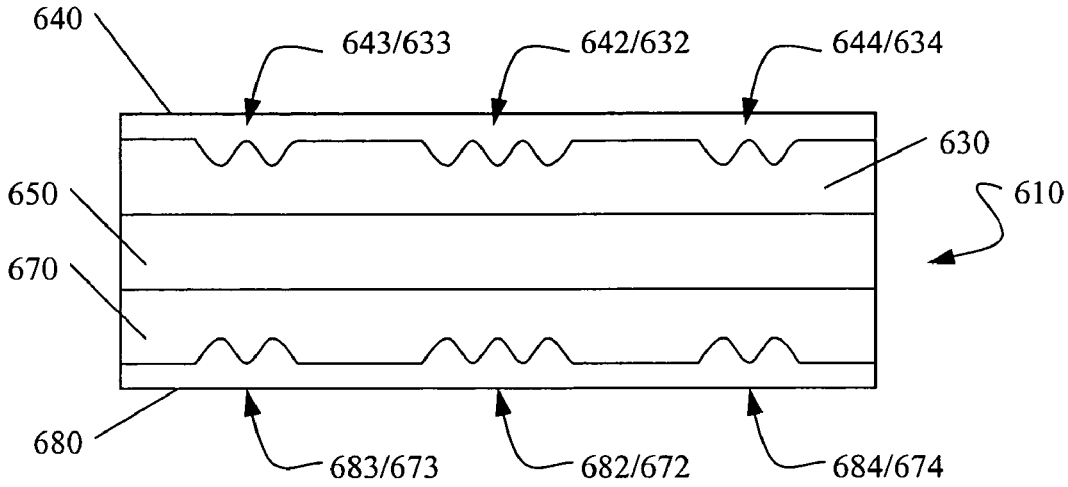
FIG. 11 is a schematic side view of a further embodiment of mattress component layers including an intermediate layer sandwiched between mattress component layers in accordance with the present invention.

FIG. 11 illustrates a schematic side view of a further embodiment of a mattress component 610 including intermediate layers in accordance with the present invention. The mattress component 610 includes a first layer 640, a second layer 630, a third layer 650, a fourth layer 670 and a fifth layer 680. The first and second layers 640, 630 and the fourth and fifth layers 670, 680 include three variation zones. The first layer 640 includes first through third mating patterns 642, 643, 644. The second layer 630 includes first through third mating patterns 632, 633, 634. The third layer does not include mating patterns. The fourth layer includes mating patterns 672, 673, 674. The fifth layer includes mating patterns 682, 683, 684.

The mating patterns 642, 643, 644 in the first layer 640 are provided to substantially match the mating patterns 632, 633, 634, respectively, in a surface of the second layer 630. In addition, the mating patterns 672, 673, 674 in the fourth layer 670 are provided to substantially match the mating patterns 682, 683, 684, respectively, in a surface of the fifth layer 680. The mating patterns are arranged in a similar manner as discussed with respect to FIG. 10. In the present embodiment, however, the third layer 650 is an intermediate layer that allows the mattress component to include the benefit of the properties from the additional layers.

Figure 12:
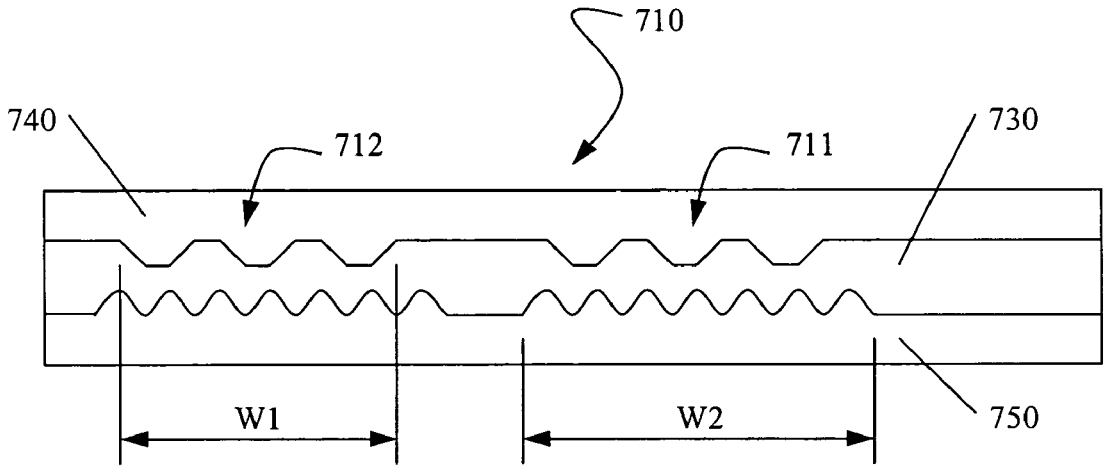
FIG. 12 is a schematic side view of a further embodiment of mattress component layers including variation zones having different pattern arrangements in accordance with the present invention.

In FIG. 12, a schematic side view of another embodiment of a mattress component 710 is illustrated in accordance with the present invention. The mattress component 710 includes a second layer 730 sandwiched between a first layer 740 and a third layer 750. Each layer includes a first variation zone 711 and a second variation zone 712. Upper portions of the variation zones 711, 712 have different mating patterns than lower portions of the variation zones 711, 712. For example, the upper portion of variation zone 711 has a larger, planar wave-shape and the lower portion of the variation zone 711 has a smaller, rounded wave-shape. In addition, the lower portion of variation zone 711 has a width W2 that is larger than a width W1 of the upper portion of the variation zone 711. For example, width W1 may be between about 17 to 18 inches and width W2 may be between about 18 to 20 inches. The different shapes and widths can provide additional variation in the material properties of the layers.

Figure 13:
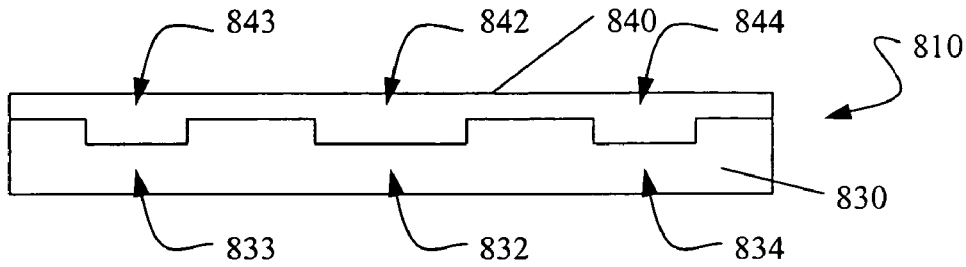
FIG. 13 is a schematic side view of a further embodiment of mattress component layers including variation zones having channel patterns in accordance with the present invention.

FIG. 13 illustrates a schematic side view of a further embodiment of a mattress component 810 in accordance with the present invention. The mattress component 810 provides three variation zones with a square-cut configuration. The mattress component 810 includes a first layer 840 and a second layer 830. The first layer 840 includes mating patterns 842, 843, 844. The second layer 830 includes mating patterns 832, 833, 834.

The mating patterns 832 in the second layer 830 are provided to substantially match the mating patterns 842 in the first layer 840 in a position where a user's hips rest. In addition, the mating patterns 833 in the second layer 830 are provided to substantially match the mating patterns 843 in the first layer 840 in a position where a user's shoulders rest. Further, the mating patterns 834 in the second layer 830 are provided to substantially match the mating patterns 844 in the first layer 840 in a position where a user's shoulders rest when the mattress component 810 is rotated about 180 degrees with respect to the user.

Figure 14:
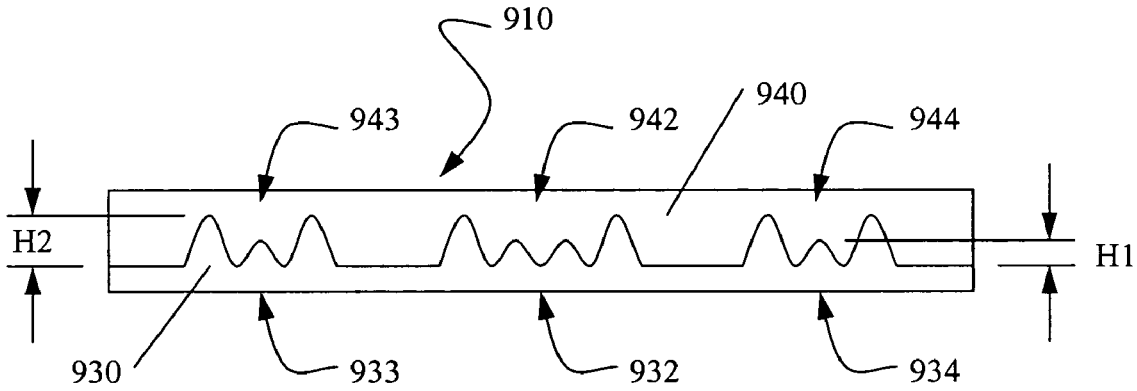
FIG. 14 is a schematic side view of a further embodiment of mattress component layers including variation zones having varying amplitude patterns in accordance with the present invention.

In FIG. 14, a schematic side view of another embodiment of a mattress component 910 is illustrated in accordance with the present invention. The mattress component 910 includes a first layer 940 and a second layer 930. Each layer includes three variation zones. The first layer 940 includes first through third mating patterns 942, 943, 944. The second layer 930 includes first through third mating patterns 932, 933, 934.

The mating patterns 932 in the second layer 930 are provided to substantially match the mating patterns 942 in the first layer 940 in a position where a user's hips rest. In addition, the mating patterns 933 in the second layer 930 are provided to substantially match the mating patterns 943 in the first layer 940 in a position where a user's shoulders rest. Further, the mating patterns 934 in the second layer 930 are provided to substantially match the mating patterns 944 in the first layer 940 in a position where a user's shoulders rest when the mattress component 910 is rotated about 180 degrees with respect to the user.

The mating patterns in the first and second layers 940, 930 in the present embodiment have a wave-shaped pattern with varying amplitudes. For example, the mating patterns 932, 942 include a peak of the wave-shape having a height H1 that is smaller than another peak having a height H2. The height H1, for example, may be between about 0.5 to 2 inches and the height H2 may be between about 0.75 to 3 inches. The variation in the amplitudes provides additional variation in the material properties of the layers.

Figure 15:
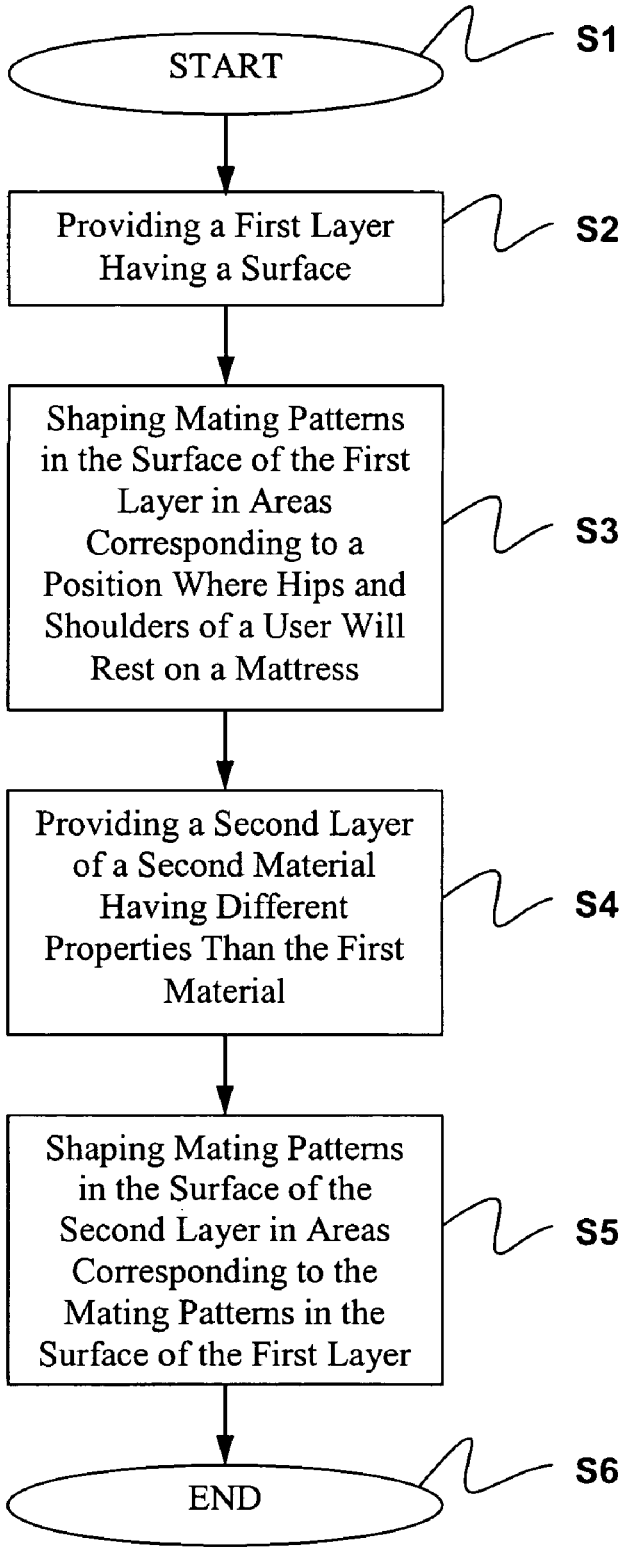
FIG. 15 is a flow chart of an embodiment of a method for making a mattress component in accordance with the present invention.

FIG. 15 is a flow chart representing a method of making a mattress component in accordance with the present invention. The method starts in step S1 and continues to step S2 where a first layer is provided having a surface. Next, step S3 involves shaping mating patterns in the surface of the first layer in areas corresponding to a position where hips and shoulders of a user will rest on a mattress. In step S4, a second layer of a second material is provided. The second material has different properties than the first material. Next, step S5 involves shaping mating patterns in the surface of the second layer in areas corresponding to the mating patterns in the surface of the first layer. Finally, the process progresses to step S6 where the method ends.

It will be appreciated from the foregoing that a wide variety of choices are available in building a mattress component in accordance with the present inventions. For example, the dimensions and shapes of the variation zones may be altered to suit a particular circumstance. The examples shown above are meant to be illustrative, and not limiting, with respect to suitable variation zones. The choice of a particular pattern and dimension will allow for emphasis of the properties of the first layer in some areas, and emphasis of the properties of the second layer in other areas in a way never before possible.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of making a mattress component, the method comprising:

providing a first layer of a first material to be assembled in a mattress over which a user will lie, the first layer having a surface;

shaping first mating patterns in the surface of the first layer in areas corresponding to a position where hips of the user will rest on the mattress, the mating patterns in the surface of the first layer including peaks and valleys and resulting in a greater effective thickness of the first layer in areas corresponding to the position where the hips of the user will rest, and a lesser effective thickness of the first layer in other areas;

shaping second mating patterns in the surface of the first layer in areas corresponding to a position where shoulders of the user will rest on the mattress, the second mating patterns in the surface of the first layer including peaks and valleys and resulting in a greater effective thickness of the first layer in areas corresponding to the position where the shoulders of the user will rest, and a lesser effective thickness of the first layer in other areas;

providing a second layer of a second material having different properties than the first material, the second layer having a surface;

shaping mating patterns in the surface of the second layer in areas corresponding to the first and second mating patterns in the surface of the first layer when the first and second layers are aligned, the mating patterns of the second layer being shaped to substantially match the mating patterns of the first layer; and assembling the first and second layers together, the mating patterns in the surface of the first layer substantially fitting with the mating patterns in the surface of the second layer in the areas corresponding to the position where hips and shoulders of the user will rest on the mattress.

2. The method of claim 1, further comprising the step of shaping an additional mating pattern in the surfaces of the first and second layers in a position where the shoulders of the user will rest when the mattress is rotated horizontally about 180 degrees.

3. The method of claim 1, further comprising:

providing a third layer of a third material having different properties than the second material, the third layer having a surface; and shaping mating patterns in the surface of the third layer in areas corresponding to the position where the hips and the shoulders of the user will rest on the mattress, the mating patterns in the surface of the third layer resulting in a greater effective thickness of the third layer in areas corresponding to the position where the hips and the shoulders of the user will rest, and a lesser effective thickness of the third layer in other areas; and shaping mating patterns in an other surface of the second layer in areas corresponding to the mating patterns in the surface of the third layer when the second and third layers are aligned, the mating patterns of the second layer being shaped to substantially match the mating patterns of the third layer.

4. The method of claim 3, further comprising the step of assembling the second and third layers together, the mating patterns in the other surface of the second layer substantially fitting with the mating patterns in the surface of the third layer.

5. The method of claim 3, wherein the mating patterns in step of shaping the mating patterns in the surface of the third layer and the step of shaping the mating patterns in the other surface of the second layer are different patterns than the mating patterns in the step of shaping the mating patterns in the surfaces of the first and second layers.

6. The method of claim 5, wherein the different patterns in the step of shaping the mating patterns in the surface of the third layer and the step of shaping the mating patterns in the other surface of the second layer include one pattern that differs by at least one of an amplitude, a width and a pattern shape.

7. A method of making a mattress component, the method comprising:

providing a first layer of a first material to be assembled in a mattress over which a user will lie, the first layer having a surface;

shaping first mating patterns in the surface of the first layer in a first variation zone proximate a position of a user's shoulders and second mating patterns in the surface of the first layer in a second variation zone proximate a position of a user's hips, the first and second mating patterns being formed to provide peaks and valleys within each of the first and second variation zones, the mating patterns in the surface of the first layer resulting in a greater effective thickness of the first layer in areas corresponding to the position where the hips and the shoulders of the user will rest, and a lesser effective thickness of the first layer in other areas;

providing a second layer of a second material having different properties than the first material, the second layer having a surface;

shaping first and second mating patterns in the surface of the second layer in the respective first and second variation zones corresponding to the first and second mating patterns in the surface of the first layer when the first and second layers are aligned, the first and second mating patterns of the second layer being shaped to substantially match the first and second mating patterns of the first layer; and assembling the first and second layers together, the mating patterns in the surface of the first layer substantially fitting with the mating patterns in the surface of the second layer.

8. The method of claim 7, further comprising the step of shaping an additional mating pattern in a third variation zone in the surfaces of the first and second layers in a position where the shoulders of the user will rest when the mattress is rotated horizontally about 180 degrees.

9. The method of claim 7, further comprising:

providing a third layer of a third material having different properties than the second material, the third layer having a surface, the first and second variation zones extending into the third layer; and shaping mating patterns in the surface of the third layer to provide peaks and valleys in the first and second variation zones in areas corresponding to the position where the hips and the shoulders of the user will rest on the mattress, the mating patterns in the surface of the third layer resulting in a greater effective thickness of the third layer in areas corresponding to the first and second variation zones, and a lesser effective thickness of the third layer in other areas; and shaping mating patterns in an other surface of the second layer to provide peaks and valleys in the first and second variation zones corresponding to the mating patterns in the surface of the third layer when the second and third layers are aligned, the mating patterns of the second layer being shaped to substantially match the mating patterns of the third layer.

10. The method of claim 9, further comprising the step of assembling the second and third layers together, the mating patterns in the other surface of the second layer substantially fitting with the mating patterns in the surface of the third layer.

11. The method of claim 9, wherein the mating patterns in step of shaping the mating patterns in the surface of the third layer and the step of shaping the mating patterns in the other surface of the second layer are different patterns than the mating patterns in the step of shaping the mating patterns in the surfaces of the first and second layers.

12. The method of claim 11, wherein the different patterns in the step of shaping the mating patterns in the surface of the third layer and the step of shaping the mating patterns in the other surface of the second layer include one pattern that differs in amplitude.

13. The method of claim 11, wherein the different patterns in the step of shaping the mating patterns in the surface of the third layer and the step of shaping the mating patterns in the other surface of the second layer include one pattern that differs in width.

14. The method of claim 11, wherein the different patterns in the step of shaping the mating patterns in the surface of the third layer and the step of shaping the mating patterns in the other surface of the second layer include one pattern that differs in a pattern shape.

15. The method of claim 9, further comprising a step of aligning the peaks in the surface second layer with the valleys of the other surface of the second layer, and aligning the valleys in the surface second layer with the peaks of the other surface of the second layer.

16. The method of claim 9, further comprising a step of aligning the peaks in the surface second layer with the peaks of the other surface of the second layer, and aligning the valleys in the surface second layer with the valleys of the other surface of the second layer.

17. The method of claim 9, wherein the step of shaping the mating patterns in the surface of the first layer include a wave-shape pattern that is shaped to have a larger wave-shape pattern than the matting patterns that are shaped in the step of shaping the mating patterns in the surface of the third layer.

18. The method of claim 9, wherein the step of shaping the mating patterns in the surface of the third layer include a mating pattern that is shaped to have a larger width than the matting patterns that are shaped in the step of shaping the mating patterns in the surface of the first layer.

19. The method of claim 7, wherein the step of shaping mating patterns in the surface of the first layer include shaping the mating patterns in a planar wave-shape pattern.

20. The method of claim 7, wherein the step of shaping mating patterns in the surface of the first layer include shaping the mating patterns in a square-cut configuration.

21. The method of claim 7, wherein the step of shaping mating patterns in the surface of the first layer include shaping the mating patterns in a wave-shaped pattern with varying amplitudes.

* * * * *